US007662048B2

(12) United States Patent
Libby et al.

(10) Patent No.: US 7,662,048 B2
(45) Date of Patent: Feb. 16, 2010

(54) GOLF SWING TRAINING DEVICE

(76) Inventors: Jason Armas Libby, 7673 Desert Vista Dr., Sparks, NV (US) 89436; William C. Libby, 1742 Sycamore Dr., Fairfield, CA (US) 94533

( * ) Notice: Subject to any disclaimer, the term of this patent is extended or adjusted under 35 U.S.C. 154(b) by 0 days.

(21) Appl. No.: 12/253,701

(22) Filed: Oct. 17, 2008

(65) Prior Publication Data

US 2009/0105005 A1 Apr. 23, 2009

Related U.S. Application Data

(60) Provisional application No. 60/980,978, filed on Oct. 18, 2007.

(51) Int. Cl.
*A63B 69/36* (2006.01)

(52) U.S. Cl. ..... 473/271; 473/207; 473/217; 473/409

(58) Field of Classification Search ..... 473/207, 473/208, 212, 217, 218, 266–275, 422, 409
See application file for complete search history.

(56) References Cited

U.S. PATENT DOCUMENTS 3,940,144 A 2/1976 Dickie
4,697,808 A * 10/1987 Larson et al. ..... 482/51
4,895,372 A 1/1990 Muller
4,946,156 A * 8/1990 Hart ..... 482/66
5,125,663 A 6/1992 Lurowist, Jr.
5,188,365 A 2/1993 Picard
5,221,089 A 6/1993 Barrett
5,334,028 A 8/1994 Melligan
5,476,441 A * 12/1995 Durfee et al. ..... 602/23
5,591,090 A 1/1997 Kauffman, Jr.
5,830,079 A 11/1998 Hudson
6,024,656 A 2/2000 Lane
6,129,638 A 10/2000 Davis
6,332,845 B1 12/2001 Priestley
6,672,973 B1 1/2004 Muntz
6,692,369 B2 2/2004 McKeon
6,843,730 B1 1/2005 Bellagamba
7,156,747 B2 * 1/2007 Perry ..... 473/270

* cited by examiner

*Primary Examiner*—Nini Legesse

(57) ABSTRACT

The present invention is a golf swing training device which guides the golfer's leading leg in an arc around the trailing heel, maintaining a minimum distance between the leading leg and trailing heel. This device guides the golfer's leg action in a 3-dimensional manner to produce a coiling motion on the backswing, which maintains a consistent spine angle as recommended by modern golf instructors. This device comprises a leg brace with flexible cuff which attaches to a golfer's leading leg above the knee, an adjustable strut, and a heel base for the golfer's trailing foot which tilts slightly in the leading direction. For left-handed golfers, this device substitutes a heel base with opposite swivel placement and tilt. This invention resets automatically to the correct position during practice sessions. The benefit for a golfer of using this invention is increased consistency, accuracy, and power.

17 Claims, 3 Drawing Sheets

GOLF SWING TRAINING DEVICE

RELATED APPLICATIONS

The present application claims priority to U.S. Provisional Application Ser. No. 60/980,978, filed Oct. 18, 2007, which is herein incorporated by reference.

BACKGROUND OF THE INVENTION

1. Field of the Invention

The present invention relates to the field of golf. More specifically, the present invention is directed toward a device for improving a golfer's swing.

2. Description of Related Art

Golf is a technically challenging sport requiring a practiced swing to both control the direction of the ball and achieve the desired height and distance.

A few terms are herein defined for clarity: "front" is the direction towards the front of the golfer's body; "back" is the direction towards the back of the golfer's body; "up" is towards the top of the golfer's body or the sky; "down" is towards the bottom of the golfer's body or the ground; "leading" is the direction in which the player intends to hit the golf ball down the target line, which is to the left for a right-handed golfer and to the right for a left-handed golfer; "trailing" is the direction in which the player moves the golf club to start the backswing, which is to the right for a right-handed golfer and to the left for a left-handed golfer; "lateral movement" is movement in either the leading or trailing direction; "posting" is a straightening of the golfer's leading leg, which starts about halfway through the downswing; a view "down the line" is a view from the golfer's trailing side, opposite the target; and a view "face on" is a view from the golfer's front side, opposite the ball.

A golf swing has three main components: 1) a backswing, where the club is moved away from the ball in the trailing direction, 2) a downswing, where the club is moved toward the ball in the leading direction, at the bottom of which the ball is hit; and 3) a follow-through continuing in the leading direction after the ball is hit.

A common swing method from the 1970's typically involved a pronounced lifting of the leading heel, rotating the hips horizontally past 45 degrees, and sliding the leading leg in the trailing direction during the backswing. These movements created a radical change in spine angle through impact into a follow-through position, called the "reverse C", in order to propel the ball into the air. This earlier method was hard for students to learn, and required that the golfer have excellent coordination for any success.

In response to these shortcomings, many effective modern swing methods have developed that have a much higher success rate for new players. These modern swing methods concentrate on minimizing or eliminating leading leg motion. These modern swing methods also maintain the integrity of down the line and face on spine angles throughout the swing. The modern swing involves 1) keeping the leading heel down, 2) rotating the leading leg, and 3) not sliding the leading leg in the trailing direction. This leg action creates a golf swing where the spine angle remains consistent throughout the swing, the spine turns in a coiling motion, and the spine does not have any lateral movement. Modern swing methods all agree that the golfer should start with the spine tilting slightly forward when viewed from down the line, and with the spine either vertical or tilted slightly in the leading or trailing direction when viewed from face on. Modern swing methods agree that the golfer's spine angle should then remain consistent throughout the backswing and the downswing. The general result of these modern swing motions is increased consistency, accuracy, and power.

A variety of approaches have developed to improve a golfer's swing, both by instruction in various swing techniques and through the use of devices to assist the practice of the various techniques. Some examples that have been proposed to guide or control the movement of the player's legs and body during the swing are set forth below.

U.S. Pat. No. 6,332,845 (PRIESTLEY) describes an apparatus that fits between the player's knees, holding the knees stable in relation to each other during the backswing and the downswing of the club, with the length selectively set. Because the device only keeps the golfer's knees at a fixed distance from each other, both knees, and the golfer's entire body, can have lateral movement in the trailing direction during the backswing. The device does not set up leg rotation and does not eliminate lateral movement.

U.S. Pat. No. 5,334,028 (MELLIGAN) describes an apparatus which uses a support frame, horizontal pivot and force translation member positioned behind the golfer's knees to force one knee to move in a direction opposite the other knee. While the device could set up a horizontal leg rotation, that rotation will not create the coiling motion on the backswing, nor does the device eliminate lateral movement, because both knees are free to move in the trailing direction during the backswing.

U.S. Pat. No. 6,024,656 (LANE) describes a device which uses a platform and brace to prevent the golfer's right knee from sliding laterally away from the target. U.S. Pat. No. 5,591,090 (KAUFFMAN JR) describes a device which uses a wide platform and leg rest so that a golfer with a leg engaging the rest will tend to avoid lateral movement. Both of those devices only place a restriction on lateral movement of the lower body in the trailing direction. They do not control the golfer's leg action in any other manner, and would therefore not encourage the preferred motion for a golf swing.

U.S. Pat. No. 5,125,663 (LUROWIST JR) describes a device which uses a platform, strut, and seat to provide a steady base, allow the hips to pivot around a vertical axis, and keep the groin area fixed in space. That device does not teach the golfer how to achieve the correct leg action. Also, while it could prevent lateral movement of the lower body, it would not eliminate and might even encourage lateral movement of the upper body if the golfer attempts to swing harder.

U.S. Pat. No. 6,129,638 (DAVIS) for a Golf Swing Training Apparatus describes a device with a waist belt and a long strap that goes around the front of the golfer's leading leg and attaches to the golfer's trailing knee, immobilizing the trailing knee. That device allows and potentially encourages the leading knee to collapse in the trailing direction towards the stabilized knee, and also does not prevent lateral movement.

The above described golf swing training devices do not optimally reinforce modern golf swing methods. The difficulties and limitations suggested in the preceding are not intended to be exhaustive, but rather are exemplary of the many devices which demonstrate that, despite much attention in the art to controlling a golfer's swing, the devices in the art will admit to useful improvements.

SUMMARY OF THE INVENTION

It is a general object of the present invention to provide a golf swing training method and device for improving a golfer's ball striking skills.

It is another general object of the present invention to provide a golf swing training method and device that can be used by persons of various heights, by men and by women, by junior golfers, and by left-handed as well as right-handed golfers.

It is a specific object of the present invention to provide a golf swing training device that guides the golfer's leading leg in an arc around the trailing heel, maintaining a minimum distance between the leading leg and trailing heel.

It another specific object of the present invention to guide the golfer's leg action in a 3-dimensional manner to produce a coiling motion on the backswing, which maintains a consistent spine angle as recommended by modern golf instructors.

It is yet another specific object of the present invention to guide the golfer's leading leg to move smoothly in three dimensions during the backswing, that is, simultaneously towards the front, towards the trailing direction, and slightly down, which movement cuts a smooth arc around the trailing foot. It is therefore an object of the present invention to cause the leading leg to move toward the front as it moves in the trailing direction, rather than falling in toward the trailing foot. It is yet another object of the present invention to guide the leading leg to move slightly down as the leading leg moves towards the front, as the golfer's leading knee is increasingly bent during the backswing. This motion of the leading leg in the front, trailing and slightly downward directions is the leg action which produces a coiling motion on the backswing.

It is an additional specific object of the present invention to provide a device that can be reset automatically after each golf swing.

A novel golf swing training device and method are described herein. The golf swing training device comprises a leg brace, a strut, and a heel base, where the leg brace is attached to one end of the strut and the heel base is attached to the other end of the strut. To practice the golf swing training method of the present invention a golfer performs one or more phases of the golf swing while the device of the present invention is attached by the leg brace to a golfer's leading thigh, and the heel base is positioned beneath the golfer's trailing foot.

The golf swing training device of the present invention guides the golfer's leading leg in an arc around the trailing heel, maintaining a minimum distance between the leading leg and the trailing heel. This device guides the golfer's leg action in a 3-dimensional manner to produce a coiling motion on the backswing, which maintains a consistent spine angle as recommended by modern golf instructors.

The golf swing training device of the present invention is a mechanical training aid which directly reinforces the tips and techniques taught by modern golf instructors. This golf swing training device teaches a golf swing movement which is typically taught to golf players as they learn the game, and can be seen repeatedly in golf instruction articles in various magazines.

The golf swing training device of the present invention is designed to guide the golfer's leg action in the correct way to achieve the recommended rotation and steady spine angle. Because the golf swing is a 3-dimensional movement, and because the golfer's leg action controls the various angles and planes through which the golf club passes during the golf swing, the simple and elegant solution is a training device that guides the golfer's leg action during the backswing, as is achieved with the present invention. The golf swing training device of the present invention is unique in the way that it guides the golfer's leading leg in order to produce the proper leg rotation, create the backswing coiling turn, and eliminate lateral movement. The device of the present invention anchors the leading thigh at a fixed distance from the trailing foot during the backswing.

The present invention may be used by both right-handed and left-handed golfers.

In a preferred embodiment, the leg brace comprises a flexible cuff that can be wrapped around the golfer's leading leg to reversibly attach the leg brace to the golfer's leading leg, and a rigid curved cuff holder, which positions and holds the device on the inner thigh area of the golfer's leading leg.

In a preferred embodiment of the present invention, the leg brace attaches to the strut with a swivel that permits horizontal and vertical adjustment of the leg brace with respect to the axis of the strut. In another preferred embodiment, the leg brace is connected to the strut with a swivel that allows the leg brace to freely rotate 360 degrees around the axis of the strut. In yet a further preferred embodiment, the leg brace is connected to the strut with a swivel that permits the leg brace to pivot both vertically and horizontally with respect to the strut but does not permit the leg brace to form an angle with the strut that is less than 30 degrees, thus preventing the rigid curved cuff holder to fall below a comfortable position against the golfer's leading leg. In a further preferred embodiment, the swivel can be reversibly locked at a desired angle along the vertical axis to prevent vertical movement of the leg brace with respect to the strut, but remain mobile along the horizontal axis to permit horizontal rotation of the leg brace around the strut. In yet a further preferred embodiment, the leg brace is connected to the strut with a swivel that may be reversibly fixed to exert constant pressure in the leading and slightly upward directions on the inside of the golfer's leading leg during the backswing.

In a preferred embodiment, the length of the strut is variable, allowing the device to adjust to fit any height of golfer. In a more preferred embodiment, the strut comprises two or more tubes which are telescopically interconnected, and the strut adjusts in length by sliding the tubes or rod and tube together or apart to maintain the desired distance between the leading leg and the trailing heel. Alternatively, the strut comprises a rod surrounded by one or more telescoping tubes which similarly adjust in length.

In a further preferred embodiment, the strut also comprises a locking mechanism for reversibly fixing the length of the strut once the desired length is obtained. Such locking mechanism includes, without limitation, a releasable lock, clip, bolt, pawl, pin or similar means which prevents the tubes which are telescopically interconnected from moving with respect to each other when locked.

In another preferred embodiment of the present invention, the locking mechanism reversibly fixes a minimum length of the strut, but allows the strut to freely lengthen, thereby providing a minimum length for the strut during the backswing and downswing, but permitting the strut to lengthen freely during the follow-through. In one embodiment, the locking mechanism is positioned on the strut so that it blocks the telescoping tubes from sliding together to shorten the strut, thereby defining a minimum length for the strut, but permits the telescoping tubes to slide apart to lengthen the strut. This embodiment allows the device to release on the follow-through, after the backswing and downswing, which is beneficial because the golfer's body movement in the follow-through changes significantly. During the follow-through, the golfer's hands, arms, shoulders, spine, hips and legs all move in the leading direction, which is facilitated by permitting the strut to lengthen freely.

This embodiment, which fixes a minimum length for the strut but allows the strut to lengthen freely during the follow-through, also allows the strut to quickly and easily reset to the starting position of the device simply by sliding the strut back to its set minimum length in preparation for another golf swing. This feature is useful because repetition is necessary in learning the correct golf swing movement, and it is therefore desirable that a golfer using the golf swing training device is able to quickly set up and then hit the next practice shot.

In a preferred embodiment, the strut attaches to the heel base by a bottom swivel that permits adjustment of the angle where the strut joins the heel base. In a preferred embodiment, the heel base is connected to the strut with a swivel such that the strut can freely move to any position with respect to the heel base.

In an embodiment of the present invention, the strut attaches to the heel base at or near the heel base leading side. In another embodiment, the strut attaches to the heel base at or near the back of the heel base toward the heel base leading side. In a preferred embodiment, the strut attaches to the top of the heel base near the heel base leading side and the back of the heel base. In another preferred embodiment, the strut attaches to the heel base behind the golfer's trailing heel, such that there is no restriction on a free and fluid swing motion. The present invention encompasses designs where the location of the connection between the heel base and the strut can be changed so that the strut can attach to the heel base at either end of the heel base leading side. In this way, the same device can be modified for use by both left-handed golfers and right-handed golfers. The present invention also encompasses designs in which a heel base for left handed golfers is provided that is a mirror-image of the same part provided for right-handed golfers.

The golfer stands with the trailing heel on the heel base. In a preferred embodiment, the heel base is tilted toward the strut, which when properly oriented on a golfer, tilts in the leading direction. This tilt of the heel base helps the golfer start the leg action which produces a coiling motion on the backswing.

In another preferred embodiment, the present invention includes a ground anchor that holds the device in place on the ground. The anchor prevents movement of the heel base during the follow-through when the golfer lifts weight off of the trailing foot. By anchoring the heel base to the ground, the golfer does not need to spend time repositioning the heel base under the trailing heel.

In one embodiment of the present invention, the golf swing training device of the present invention comprises: an strut having a first end and a second end; a leg brace attached to the first end of the strut; and a heel base attached to the second end of the strut. In a preferred embodiment, the leg brace comprises: a flexible cuff and a rigid curved cuff holder. In another embodiment the leg brace attaches to the first end of the strut by a top swivel, and the heel base attaches to the second end of the strut by a bottom swivel.

In yet another embodiment the leg brace freely swivels around the strut. In a further embodiment, the golf swing training device further comprises a top swivel locking mechanism that can be attached to the top swivel to reversibly fix the angle of the leg brace with respect to the strut. In a more specific embodiment, the heel base is free to swivel around the strut.

In one embodiment of the present invention the length of the strut is adjustable. In another embodiment, the strut comprises a rod surrounded by a telescoping tube. In a more specific embodiment, the strut further comprises a locking mechanism that reversibly fixes the minimum length of the strut while allowing the strut to freely lengthen. The locking mechanism can comprise a locking pin that slides into a hole in the strut.

In another embodiment the heel base comprises a heel base top that is tilted toward the strut. In one embodiment, the present invention further comprises a ground anchor attached to the heel base. The heel base can have a bore or more than one bore, and the present invention can further comprise a ground anchor which can pass through the bore of the heel base to reversibly fix the heel base to the earth.

In a preferred embodiment, the heel base has a heel base leading side, a first heel base end and a second heel base end, and the strut attaches to the heel base leading side near the first heel base end. Alternatively, the strut attaches to the heel base leading side near the second heel base end.

In one embodiment, the heel base can be reversibly moved to attach near either the first heel base end or the second heel base end to accommodate both right handed and left handed golfers.

In another preferred embodiment, the strut attaches to the top of the heel base near the heel base leading side and the back of the heel base. In another preferred embodiment, the strut attaches to the heel base behind the golfer's trailing heel, so as not to interfere with a free and fluid swing motion. In yet another preferred embodiment, the heel base is a mirror-image part provided for left-handed golfers.

The present invention further contemplates a golf swing training process, comprising: providing a golf swing training device comprising: a strut having a first end and a second end; a leg brace attached to the first end of the adjustable strut; and a heel base attached to the second end of the adjustable strut; adjusting the strut to a desirable length; placing a golfer's trailing foot on the heel base; and swinging the golf club. In a preferred embodiment, the golf swing training process further comprises adjusting the strut to a desirable length before or as the leg brace is attached to a golfer's leading leg.

DESCRIPTION OF THE FIGURES

The foregoing and other objects or features and advantages of the present invention will be made apparent from the following detailed description of the preferred embodiments of the invention and from the drawings in which.

DETAILED DESCRIPTION OF THE PREFERRED EMBODIMENTS

Figure 1:
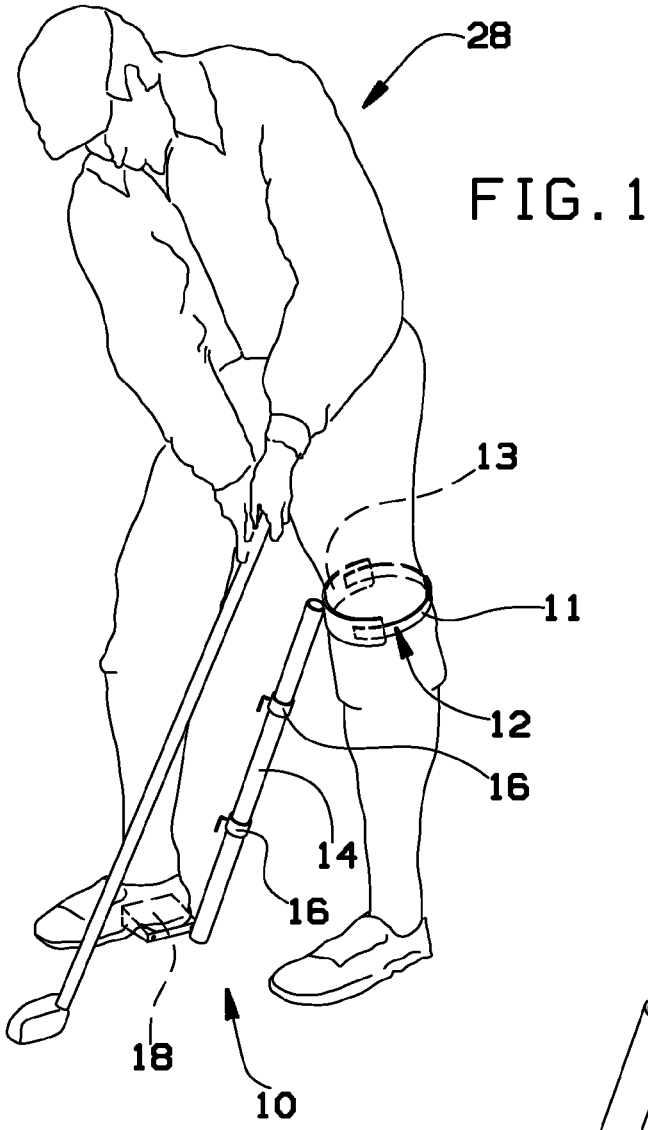
FIG. 1 is a perspective view of the present invention taken from the forward direction showing of a golfer using the golf swing training device of the present invention.

Referring now to the drawings, and in particular to FIG. 1, wherein an embodiment of a golf swing training device of the present invention is provided, there is shown the front side of a golf swing training device 10 as used by a right handed golfer 28. The golfer is standing in a standard address position, ready to take a practice swing or hit a practice ball. The golfer's body is upright, with the feet spaced apart at approximately shoulder width. The golf swing training device 10 comprises a leg brace 12, a strut 14, and a heel base 18. The leg brace 12 is attached to one end of the strut 14 and the heel base 18 is attached to the other end of the strut 14. In this embodiment, the leg brace 12 comprises a flexible cuff 11 and a rigid curved cuff holder 13, which allows the leg brace 12 to be fitted comfortably around the thigh of the golfer's leading leg. The heel base 18 is situated under the golfer's trailing foot.

For use by a right handed golfer, as shown, the leading leg, upon which the leg brace 12 is placed, is the golfer's left leg, and the trailing foot, which rests on the heel base 18, is the golfer's right foot. For use by a left handed golfer, the leg brace 12 is attached to the right thigh and the heel base 18 is situated under the left foot. These main components of the present invention are designed to maintain a minimum distance between the golfer's leading leg and trailing heel throughout a golf swing.

Figure 2:
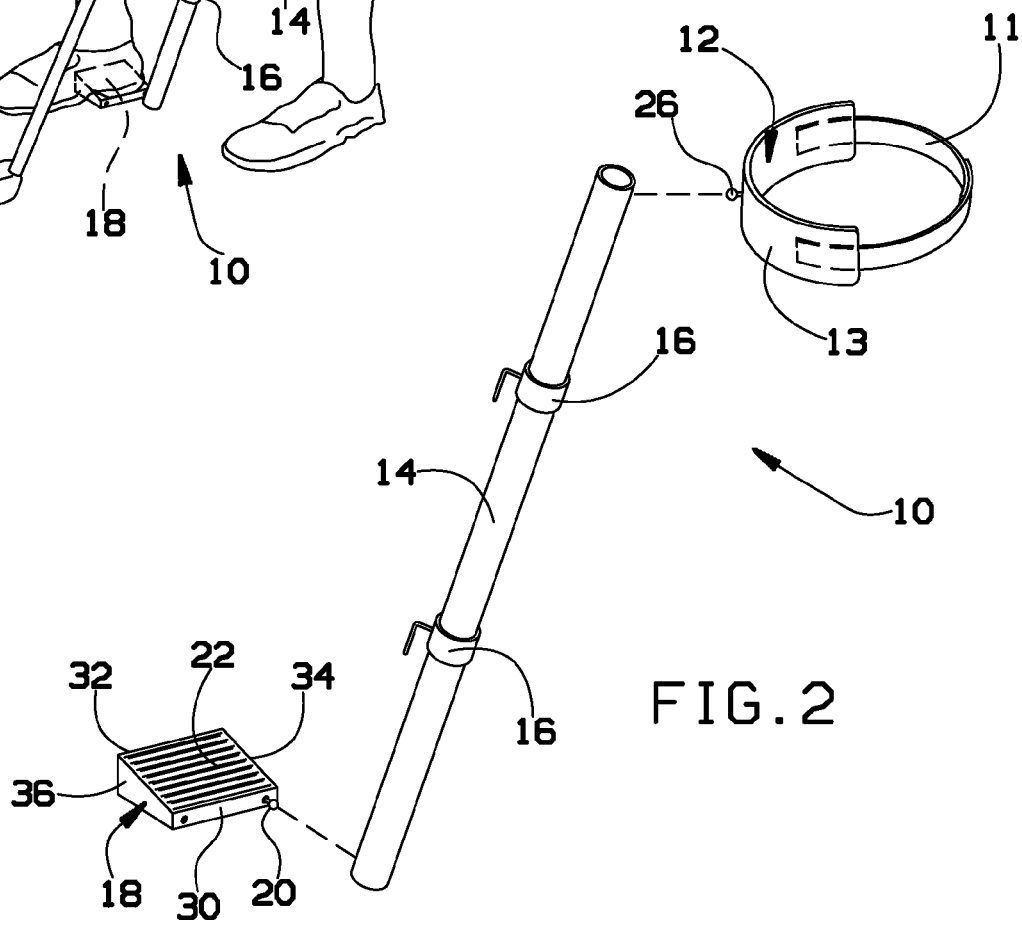
FIG. 2 is an exploded perspective view of the device of the present invention.
Figure 3:
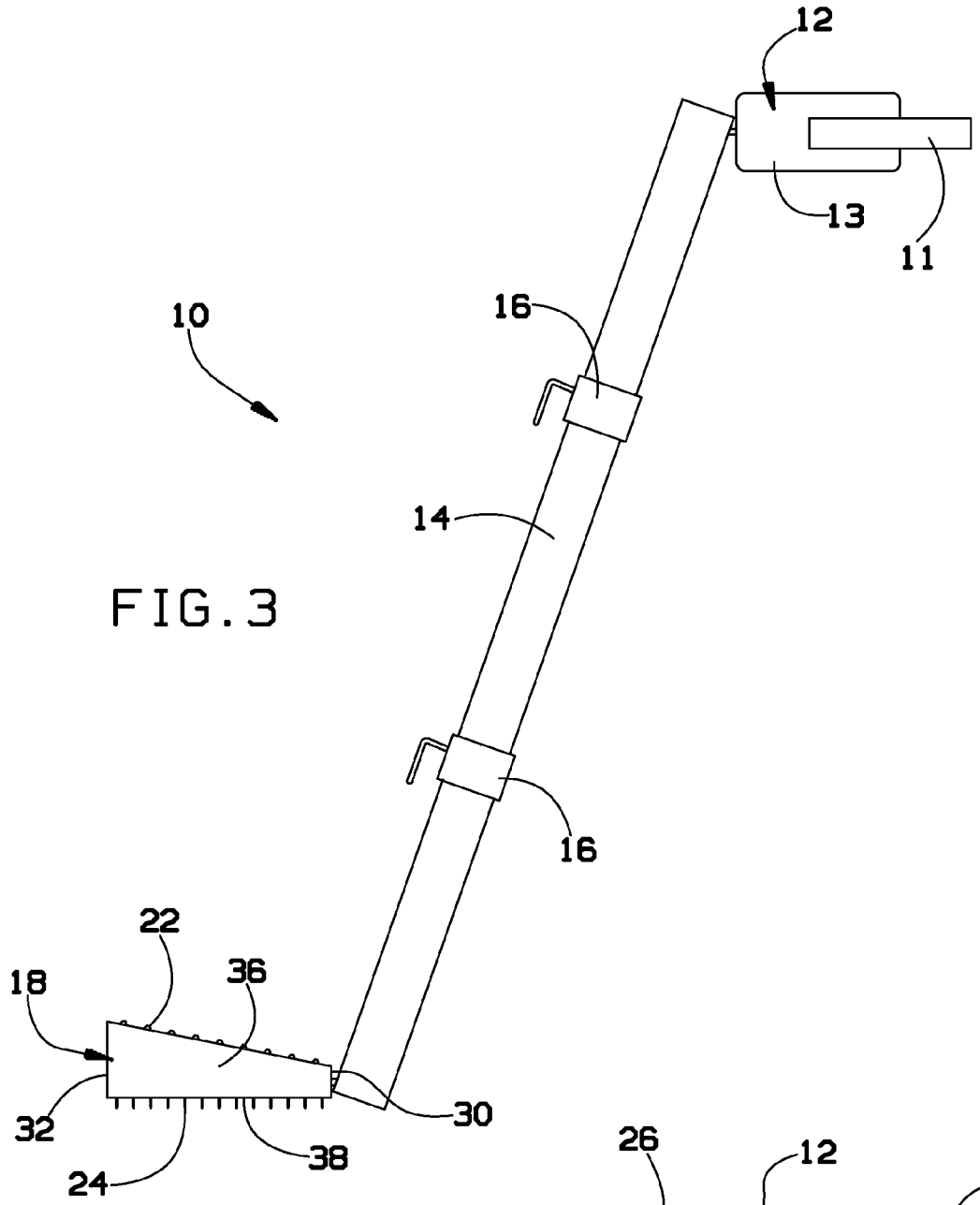
FIG. 3 is a side elevation view of the device of the present invention.

The strut 14 of the present invention can be fixed in length, in which case the device of the present invention could be made in different sizes, by varying the strut 14 lengths, in order to accommodate different golfer size requirements. However, in a preferred embodiment of the present invention the length of the strut 14 is adjustable. FIGS. 1, 2 and 3 depict the strut 14 comprising telescoping tubes, and also comprising a locking mechanism 16 which adjustably fixes the minimum length of the strut 14 to ensure an appropriate set-up distance between the golfer's leading leg and trailing heel in the standard address position.

There are many known designs for an adjustable strut that would be acceptable for use in the present invention, including, without limitation, adjustable legs such as are found in camera stands, portable art easels, or portable camping tables. In a preferred embodiment the strut 14 comprises an enclosing tube and a sliding bar or tube located inside and able to slide within the enclosing tube. The strut 14 can be made of any substantially rigid material, including, without limitation, metal, wood, plastic, carbon fiber, or any other suitable material. In a preferred embodiment the strut is made of aluminum or steel for strength and durability. In a preferred embodiment, the telescoping set of tubes allows only a sliding movement for length adjustment.

The proper sizing of the golf swing training device 10 to the golfer, if the strut 14 is not adjustable, or the proper adjustment of the length of the strut 14 to suit the golfer, if the strut 14 is adjustable, is important because the distance set in the golfer's standard address position becomes the minimum distance maintained by the golf swing training device 10 during the golfer's backswing.

FIG. 2 is an exploded perspective view of the golf swing training device 10, illustrating the leg brace 12, the strut 14, and the heel base 18. The leg brace 12 comprises a flexible cuff 11 and a rigid curved cuff holder 13. Also shown is a top swivel 26 that, in a preferred embodiment, joins the leg brace 12 to the strut 14. The strut 14 shown is adjustable and has a locking mechanism 16 which can be employed to adjust and fix the minimum length of the strut 14. The heel base 18 has a heel base top 22 upon which the golfer's foot can rest and is large enough to be secure under the golfer's foot. The heel base 18 is further defined by a heel base leading side 30, a heel base trailing side 32, a first heel base end 34 and a second heel base end 36. In a preferred embodiment the heel base top 22 is tilted slightly toward the heel base leading side 30, and therefore also toward the strut 14 which is attached to the heel base 18 near the corner where the heel base leading side 30 and the first heel base end 34 meet.

In a preferred embodiment, the strut 14 attaches to the heel base 18 toward the first heel base end 34, for use by a right handed golfer, and toward the second heel base end 36, for use by a left handed golfer. A golfer can then place the trailing foot on the heel base 18 with the heel at or near the connection of the heel base 18 and the strut 14, so that the majority of the heel base 18 is situated under the golfer's foot, as shown in FIG. 1.

Also pictured is a bottom swivel 20 positioned on the heel base leading side 30 toward the first heel base end 34, and which in a preferred embodiment is a means of joining the heel base 18 to the strut 14. In an alternate embodiment, the bottom swivel 20 is positioned toward the second heel base end 36 to accommodate a left handed golfer.

FIG. 3 is a side elevation view of the golf swing training device 10, further illustrating the leg brace 12, strut 14, and heel base 18 components. In the embodiment shown, a ground anchor 24 projects from the bottom of the heel base 18, which permits the heel base 18 to be temporarily secured to the ground while the device is in use. The strut 14 shown is also adjustable in length by means of a locking mechanism 16.

Figure 4:
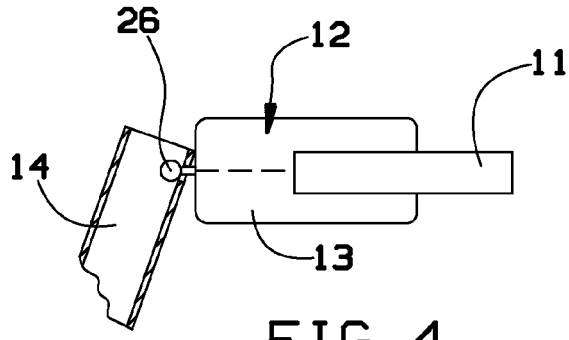
FIG. 4 is a sectional view of a leg brace and its attachment to a strut.

FIG. 4 is a sectional view of the leg brace 12 and it's attachment to the strut 14. The leg brace 12 of this preferred embodiment is connected by a top swivel 26 to the strut 14. In the embodiment shown, the leg brace 12 comprises a flexible cuff 11 and a rigid curved cuff holder 13. The flexible cuff 11 attaches around the golfer's leg above the knee. The rigid curved cuff holder 13 curves partially around the golfer's leg to help secure the golf swing training device 10 in the desired position on the inner thigh of the golfer. The rigid curved cuff holder 13 can additionally have one or more attachments or guides where the flexible cuff 11 and the rigid curved cuff holder 13 contact each other, to hold the flexible cuff 11 in place. The rigid curved cuff holder 13 can be made of a rigid material or a substantially rigid material that has some flexibility to bend around the leg, including without limitation aluminum, steel, plastic, wood, acrylic or any other suitable material, but preferably is made of aluminum or steel for strength and durability.

In a preferred embodiment the flexible cuff 11 is both comfortable and secure when it is fitted around the golfer's leg. The flexible cuff 11 can be made of any flexible material, including, without limitation, fabric, plastic, Velcro™, elastic, leather, bungee-cord, or any other suitable material, but in a preferred embodiment is made of a material with hook-to-eye reversible closure ability, such as Velcro™. The flexible cuff 11 is secured around the golfer's leg using any appropriate securing means, including, without limitation, a hook-to-eye reversible closure, one or more buckles or snaps, a bungee-cord clasp, or any other suitable securing means, and in a preferred embodiment using Velcro™ hook-to-eye attachment.

Figure 5:
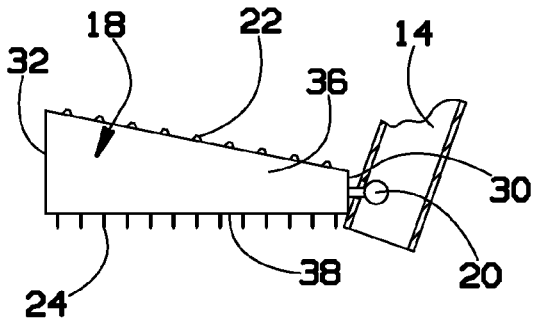
FIG. 5 is a sectional view of a heel base and its attachment to a strut.

FIG. 5 is a sectional view of the heel base 18 and its attachment to the strut 14. The heel base 18 of this preferred embodiment is connected to the strut 14 by a bottom swivel 20. The heel base comprises a heel base top 22 and a heel base bottom 38. The heel base top 22 in this embodiment has a ribbed surface which provides traction to hold the golfer's foot on the heel base 18 during the backswing and downswing. The heel base bottom 38 has a plurality of ground anchors 24 projecting down from the bottom of the heel base 18.

FIGS. 2 and 4 illustrate the top swivel 26 which attaches the strut 14 to the leg brace 12. The top swivel 26 can be made of any resilient material, including, without limitation, metal, plastic, wood, or any other suitable material. In a preferred embodiment, the top swivel 26 is made of aluminum or steel for strength and durability. The top swivel 26 can comprise any means of attaching two items that permits the items to move with respect to each other. However, in a preferred embodiment the top swivel 26 comprises a universal joint or a ball and socket type joint.

In one embodiment, the top swivel 26 permits the leg brace 12 to rotate freely in any three dimensional direction at the connection with the strut 14, so that the leg brace 12 may be fitted comfortably on the golfer's leg. Specifically, the top swivel 26 permits horizontal and vertical adjustment of the leg brace 12 with respect to the strut 14. In another embodiment, the top swivel 26 allows the leg brace 12 to freely rotate 360 degrees around the strut 14 in a plane that is substantially perpendicular to the axis of the strut 14.

In a further preferred embodiment, the top swivel 26 permits the leg brace 12 to pivot substantially vertically with respect to the strut 14 but does not permit the leg brace 12 to form an angle with the axis of the strut 14 that is less than 30 degrees, thus preventing the rigid curved cuff holder 13 from moving out of a comfortable position against the golfer's leg.

In a further preferred embodiment, the top swivel 26 can be reversibly locked with a top swivel locking mechanism to set the leg brace 12 at a desired angle with respect to the vertical axis of the strut 14 to prevent movement of the leg brace along the vertical axis of the strut 14 during use, while allowing horizontal rotation of the leg brace 12 around the axis of the strut 14. The benefit of employing a top swivel locking mechanism is that the leg brace 12 can be comfortably positioned on the golfer's leg, then locked into place to prevent the rigid curved cuff holder 13 from shifting and digging into the golfer's leg during use.

FIGS. 1, 2 and 3 illustrate the locking mechanism 16. The locking mechanism 16 sets the minimum length of the strut 14, using one or more collars with locking pins, clasps, hasps, or other mechanical locking arrangements for telescoping tubes. In a preferred embodiment, the locking mechanism sets the minimum length of the strut 14 but allows the strut 14 to slide open to the posting length. The posting length of the strut 14 is greater than the minimum length, and is the length to which the strut slides open when the golfer posts on the leading leg, which begins during the downswing and continues into the follow-through.

In another preferred embodiment a locking pin may be fitted into one of several bores placed at intervals through either the sliding bar or the enclosing tube, or both, in order to securely fix the minimum length of the strut 14. One preferred embodiment can fix the length of the strut 14 by either placing the locking pin through a bore in the enclosing tube, thereby limiting movement of the sliding bar; or by placing the locking pin in the bore in the sliding bar, thereby limiting movement of the enclosing tube. In either case, the preferred embodiment limits the minimum length of the strut 14 but allows the strut to slide open to the posting length. Enabling the strut to open to the posting length ensures that the device does not restrict movement of the leading leg away from the heel base 18 during the downswing and follow-through.

As shown in FIGS. 2 and 5, the bottom swivel 20 attaches the bottom of the strut to the heel base and is made of any resilient material, including, without limitation, metal, plastic, wood, or any other suitable material, and more preferably of aluminum or steel for strength and durability. The bottom swivel 20 permits adjustment of the angle where the strut joins the heel base. In a preferred embodiment, heel base 18 is connected to the strut 14 with a swivel that allows the heel base 18 to freely rotate completely around the strut 14 allowing a full 360 degree rotation, and the vertical swivel movement of the heel base 18 with respect to the strut 14 is not restricted, such that the strut 14 can take any position with respect to the heel base 18. Without intending to limit the invention to any particular swivel, a ball bearing swivel would be suitable for the bottom swivel 20 of the present invention.

FIGS. 2, 3 and 5 illustrate the heel base 18 having a heel base top 22 which goes under the golfer's foot and is large enough to be comfortable and secure under the golfer's foot. In a preferred embodiment the heel base top 22 is tilted slightly toward the strut 14, which is in the leading direction when the device is properly oriented on a golfer.

The heel base 18 can be made of any resilient material, including, without limitation, aluminum, steel, rubber, wood or plastic. In a preferred embodiment, the heel base 18 is made of aluminum or steel for strength and durability. The bottom swivel 20 can be made of any resilient material, including, without limitation, aluminum, steel or plastic, but preferably of aluminum or steel for strength and durability.

In one embodiment, the heel base top 22 has a heel position indicator to help the golfer position the trailing foot properly on the heel base 18. The heel position indicator is a visual aid to the golfer, and can be any visible marking, including without limitation a decal, curved painted stripe, or shape cut or formed into the base.

FIGS. 3 and 5 show the optional ground anchor 24 fixed at the bottom of the heel base 18. The ground anchor 24 can be used by the golfer to secure the base into the ground. While the ground anchor 24 pictured projects from the heel base bottom 38, the ground anchor 24 can consist of any protrusion passing through the heel base 18, projecting from the heel base bottom 38, or permanently or reversibly attaching in any way to the heel base 18 to anchor the heel base 18 to the ground. The ground anchor 24 may comprise, without limitation, one or more rods having a wide head and a narrow body, wherein the heel base 18 has one or more bores through which the narrow body of the rod can pass but the wide head of the rod cannot pass. An example of such a rod is a golf tee. Alternatively, the ground anchor 24 may comprise molded teeth, spikes or other protrusions that can be pushed into the ground. In a preferred embodiment, the ground anchor 24 comprises two or more long wooden or plastic golf tees that are pushed through holes which are provided in the heel base, and which secure the heel base 18 to the ground while preventing the ground anchor from turning. This embodiment enables the bottom portion of the heel base 18 to be flat for indoor practice sessions, but during outdoor practice sessions the heel base 18 can be anchored directly into the ground.

FIG. 1 shows a right-handed golfer 28. This golf swing training device has the same design for right-handed and for left-handed golfers with respect to the leading direction. The strut 14 preferably attaches to the heel base 18 at the heel base leading side 30 that is toward the golfer's back, so that the strut 14 meets the heel base 18 near the golfer's heel, while permitting a substantial portion of heel base 18 to rest below the golfer's foot. FIG. 2 shows the bottom swivel 20 positioned toward the right side of the heel base leading side 30. The illustrations do not show a preferred embodiment for a left-handed golfer, which takes the form of a mirror image of the design for a right-handed golfer, in which the strut 14 attaches to the heel base 18 toward the left side of the heel base leading side 30, such that the bottom swivel 20 is repositioned toward the left side of the heel base leading side 30.

Figure 6:
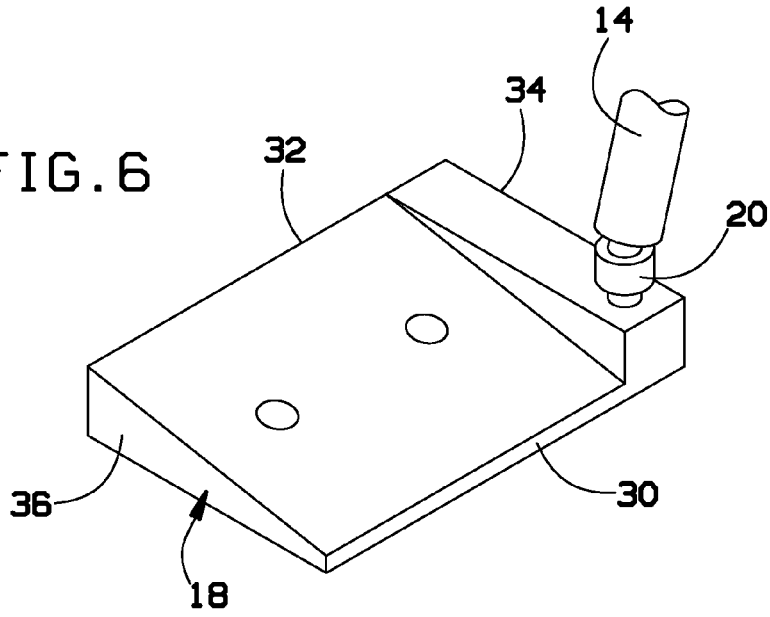
FIG. 6 is a perspective view of a heel base and its attachment to a strut.

FIG. 6 shows a perspective view of a preferred embodiment of the heel base 18 and its attachment to the strut 14. In this view, the strut 14 attaches to the top of the heel base 18 near the heel base leading side 30 and the first heel base end 34. In a preferred embodiment, the strut attaches to the heel base 18 behind the golfer's trailing heel, so as not to interfere with a free and fluid swing motion. In this preferred embodiment, a narrow section of the heel base 18 along the first heel base end 34 is raised with respect to the rest of the heel base 18 to form a flat area along the top of that section of the heel base 18. The bottom swivel 20 attaches to the heel base 18 on this narrow raised section of the heel base 18 near the first heel base end 34. In this embodiment the golfer's foot rests on the portion of the heel base 18 that is not raised and that is tilted toward the heel base leading side 30. The golfer's heel can rest up against the raised portion of the heel base 18. In this preferred embodiment of the device, the strut 14 cannot be attached toward the second heel base end 36, therefore a heel base that is a mirror-image part will be provided for left-handed golfers.

Figure 7:
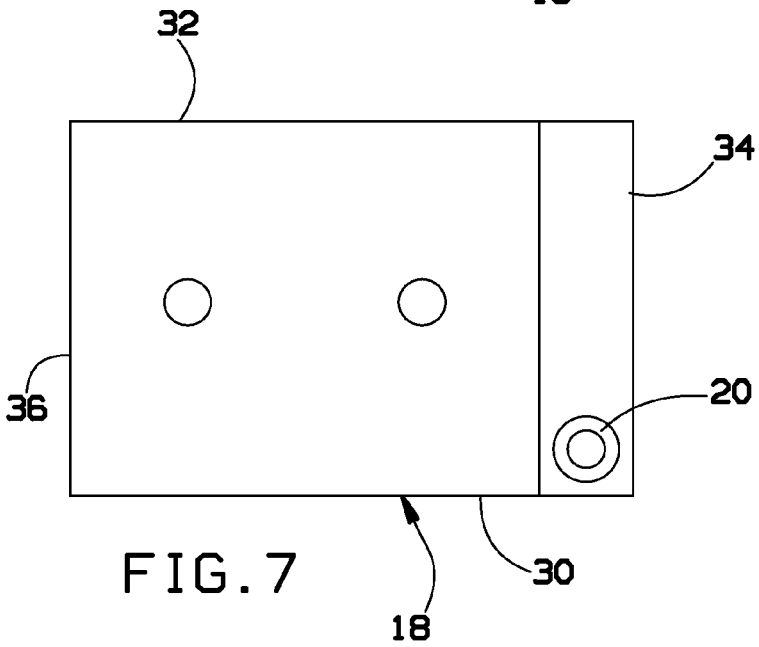
FIG. 7 is a top view of the heel base depicted in FIG. 6.

FIG. 7 shows a top view of the heel base 18 depicted in FIG. 6. The bottom swivel 20 is attached on the top of the heel base 18 near the heel base leading edge 30 and the first heel base end 34 on the portion of the heel base 18 that is raised.

Figure 8:
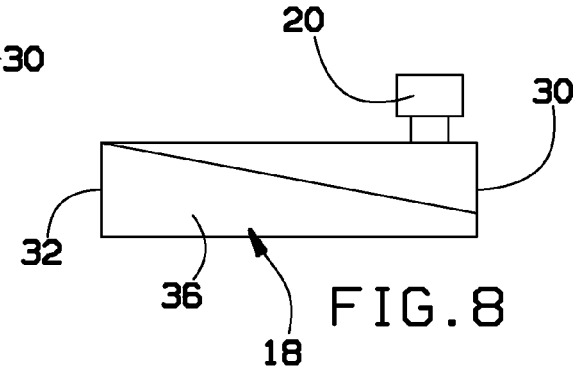
FIG. 8 is an end view of the heel base depicted in FIG. 6.

FIG. 8 is an end view of the heel base 18 depicted in FIG. 6, such that the raised flat portion of the heel base 18 can be seen behind the tilted portion of the heel base 18. The second heel base end 36 is in the front, with bottom swivel 20 at the far end of the heel base 18 near the heel base leading side 30.

Figure 9:
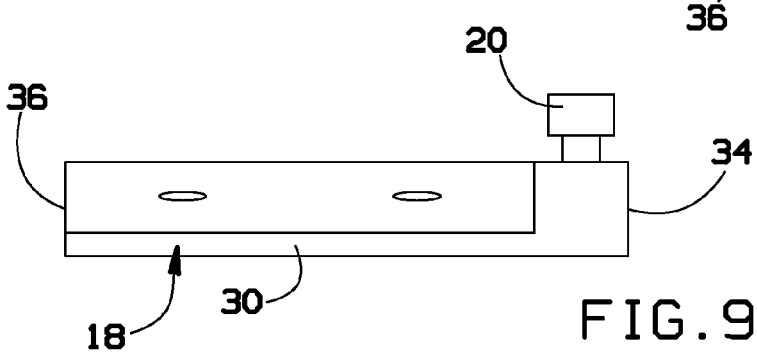
FIG. 9 is a side view from the leading side of the heel base depicted in FIG. 6.

FIG. 9 shows a view from the leading side of the heel base 18 depicted in FIG. 6. The bottom swivel 20 is positioned on top of the heel base 18 near the first heel base end 34.

FIGS. 6, 7 and 9 show two bores near the center of the heel base 18 through which a rod can be passed to act as a ground anchor. In a preferred embodiment, the ground anchor comprises two or more long wooden or plastic golf tees that are pushed through these bores in the heel base 18, and which secure the heel base 18 to the ground while preventing the heel base 18 from turning. This embodiment enables the bottom portion of the heel base 18 to be flat for indoor practice sessions, but during outdoor practice sessions the heel base 18 can be anchored directly into the ground.

Test trials of the present invention indicated the desirability of simple reset features to enable the golfer to return the device rapidly to the starting position. If the strut 14 has a locking mechanism 16 which fixes the length of the strut 14, then the device may restrict somewhat the golfer's follow-through. Therefore, in a preferred embodiment, the locking mechanism 16 can be set to limit the strut 14 to a minimum length while enabling the strut to freely lengthen to accommodate movement of the leading leg away from the heel base 18 during the follow-through. The strut 14 can quickly be returned to the desired minimum length for the next practice shot.

If the golfer's weight remains on the heel base 18 during the backswing and downswing, but lifts off the heel base during the golfer's follow-through, then the heel base can move out and the golfer must take time to reposition the heel base under the trailing foot for the next practice shot. Therefore the preferred embodiment of the heel base 18 includes the ground anchor 24 which keeps the heel base anchored in the ground when used outdoors. In summary, the preferred embodiments of the locking mechanism 16 and the ground anchor 24 provide desirable rapid and simple reset features for the present invention.

The above specification, examples and data provide a complete description of the manufacture and use of the embodiments of the present invention. While the devices and related methods have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims. All the patents discussed or cited above are herein incorporated by reference. Where used, the expression "without limitation" means that the options listed are not the only options contemplated by the present invention. However, even where "without limitation" is not stated, it should be appreciated that the particular implementations shown and described herein are not intended to limit the scope of the invention in any way, but are offered only as examples. Indeed, for the sake of brevity, conventional aspects of embodiments of the invention may not be described in detail herein.

The invention claimed is:

1. A golf swing training device, comprising:

a) a strut having a first end and a second end;

b) a leg brace attached to the first end of the strut;

c) a heel base attached to the second end of the strut wherein when a trailing foot of a golfer stands on top of the heel base, the leg brace attaches to the leading leg of the golfer, thereby limiting collapse of the leading leg of the golfer toward the trailing foot of the golfer during a golf swing.

2. The golf swing training device of claim 1, wherein the leg brace comprises: a flexible cuff.

3. The golf swing training device of claim 1, wherein the leg brace attaches to the first end of the strut by a top swivel, and wherein the heel base attaches to the second end of the strut by a bottom swivel.

4. The golf swing training device of claim 3, wherein the heel base is free to swivel around the strut.

5. The golf swing training device of claim 1, wherein the length of the strut is adjustable.

6. The golf swing training device of claim 5, wherein the strut comprises a rod surrounded by a telescoping tube.

7. The golf swing training device of claim 5, wherein the strut further comprises a locking mechanism that reversibly fixes the minimum length of the strut while allowing the strut to freely lengthen.

8. The golf swing training device of claim 7, wherein the locking mechanism comprises a locking pin that slides into a hole in the strut.

9. The golf swing training device of claim 1, wherein the heel base comprises a heel base top that is tilted toward the strut.

10. The golf swing training device of claim 1, further comprising a ground anchor attached to the heel base.

11. The golf swing training device of claim 1, wherein the heel base has a bore, further comprising a ground anchor which can pass through the bore of the heel base to reversibly fix the heel base to the earth.

12. The golf swing training device of claim 1, wherein the heel base has a heel base leading side, a first heel base end and a second heel base end, and wherein the strut attaches to the heel base leading side near the first heel base end.

13. The golf swing training device of claim 1, wherein the heel base has a heel base leading side, a first heel base end and a second heel base end, and wherein the strut attaches to the heel base leading side near the second heel base end.

14. The golf swing training device of claim 13, wherein the heel base can be reversibly moved to attach near the first heel base end to accommodate both right handed and left handed golfers.

15. The golf swing training device of claim 14, further comprising: a locking mechanism that reversibly fixes the minimum length of the strut while allowing the strut to freely lengthen.

16. A golf swing training method, comprising the following steps, not necessarily in the order shown:

a) providing a golf swing training device comprising: an adjustable strut having a first end and a second end; a leg brace attached to the first end of the adjustable strut; and a heel base attached to the second end of the adjustable strut;

b) placing a golfer's trailing foot on the heel base;

c) attaching the leg brace to a golfer's leading leg; and d) swinging a golf club.

17. The golf swing training process of claim 16, further comprising adjusting the adjustable strut to a desirable length.

* * * * *